United States Patent [19]

Bankstahl

[11] 4,178,873

[45] Dec. 18, 1979

[54] EXHAUST COUPLING ASSEMBLY FOR A MARINE STERN DRIVE

[75] Inventor: Herbert A. Bankstahl, Fond Du Lac, Wis.

[73] Assignee: Brunswick Corporation, Skokie, Ill.

[21] Appl. No.: 875,447

[22] Filed: Feb. 6, 1978

[51] Int. Cl.[2] ..... F01N 3/00

[52] U.S. Cl. ..... 115/73; 115/35; 180/296

[58] Field of Search ..... 115/73, 41 R, 41 HT, 115/34 R, 35; 180/64 A; 60/280, 317

[56] References Cited

U.S. PATENT DOCUMENTS

| | | | |
|---|---|---|---|
| 3,183,880 | 5/1965 | Shimanckas | 115/41 R |
| 3,190,254 | 6/1965 | Meibauer | 115/73 |
| 3,396,693 | 8/1968 | Bergstedt | 115/41 R |
| 3,908,368 | 9/1975 | Witt | 180/64 A |

*Primary Examiner*—Jesus D. Sotello

*Attorney, Agent, or Firm*—Andrus, Sceales, Starke & Sawall

[57] ABSTRACT

A marine stern drive includes an inboard engine having an exhaust passageway connected to an outboard drive unit having an exhaust passageway. A transom bracket assembly positioned between the engine and the drive unit permits vertical pivoting of the drive unit for steering and horizontal pivoting of the drive unit for steering and horizontal pivoting of the drive unit for trimming. The improvement includes a first exhaust pipe connected to the inboard engine and a second exhaust pipe connecting to the drive unit. The first exhaust pipe extends outward through the transom of the boat and has an open end position centered on and adjacent the vertical pivot axis and below the vertical pivot axis. The second exhaust pipe extends towards and ends in alignment with the end position of the first exhaust pipe to form an interface which includes an opening between the pipe ends.

10 Claims, 10 Drawing Figures

EXHAUST COUPLING ASSEMBLY FOR A MARINE STERN DRIVE

BACKGROUND OF THE INVENTION

The invention relates to the exhaust connection for a marine stern drive unit and particularly concerns a two-piece non-connecting exhaust coupler.

Marine stern drive units generally utilize a flexible bellows to connect between the ends of the respective exhaust pipes of the engine and drive unit. The flexible bellows provides a sealed continuous passageway. But since marine stern drive units generally not only require movement for steering and for trim adjustment, they also require an extreme movement for tilt up or launch. This requires a flexible bellows which has a large range of flexibility. When a sufficient range of flexibility is provided, the bellows may have a tendency to sag as well as to wear excessively.

SUMMARY OF THE INVENTION

A stern drive for propulsion of a boat including (A) an inboard engine having an exhaust passageway means, (B) an outboard drive unit coupled to the engine having an exhaust passageway means, (C) a transom mounting assembly including pivot mounting means positioned between the inboard engine and the drive unit, the pivot mounting means including a vertical pivot axis for steering and a horizontal pivot axis for trimming of the drive unit the improvement which comprises (a) a first exhaust pipe connected to the inboard engine exhaust means and extending outward through the transom of a boat having an open end position centered on; adjacent the vertical pivot axis; and below the horizontal pivot axis (b) a second exhaust pipe connected to the exhaust passageway means of the drive unit extending towards and ending in alignment with the end position of the first exhaust pipe to form an interface which includes an opening which permits a substantially equal exhaust leakage over the entire range of movement of the drive unit.

The two piece coupler assembly eliminates the disadvantages of the prior flexible bellows and permits removal and assembly of the drive unit without the need to disconnect an exhaust coupler.

DESCRIPTION OF THE PREFERRED EMBODIMENT

Figure 1:
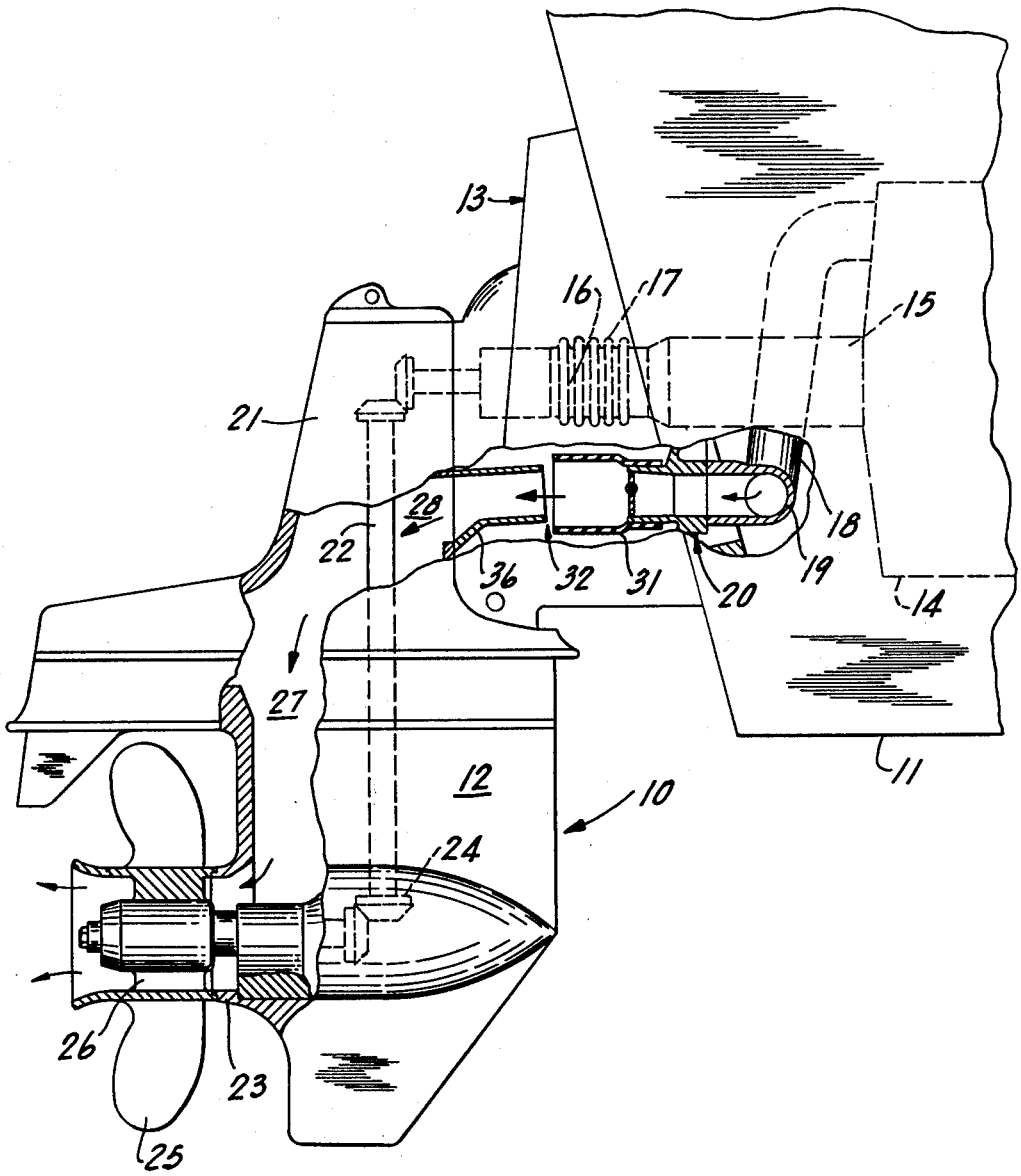
FIG. 1 is a fragmentary side elevational view of an inboard/outboard mounted unit with parts broken away and sanctioned.

FIGS. 1 through 4 illustrate a marine stern drive 10 positioned on a boat 11. The stern drive 10 includes a pendant outboard drive unit 12, a transom bracket assembly 13 and an inboard mounted engine 14.

The engine 14 includes an output shaft 15 which is connected to the drive unit 12 by universal means 16, having a flexible cover 17. The engine 14 also includes an exhaust pipe 18. The engine exhaust pipe 18 includes a first portion 19 connected to the engine 14 and a second portion 20 integrally cast as a part of the transom bracket assembly 13.

The drive unit 12 includes a drive unit housing 21 supporting a generally vertical drive shaft 22, a horizontal propeller shaft 23 and gearing 24 connecting the vertical and horizontal shafts 22 and 23 respectively. A propeller 25 is secured to the propeller shaft 23. The propeller 25 illustrated in FIG. 1 has a hollow hub 26 similar to the propeller used in a jet prop exhaust as illustrated in U.S. Pat. No. 3,487,804. The hollow hub 26 of the propeller 25 connects to an exhaust passageway 27 in the drive housing 21. The exhaust passageway 27 connects to a drive unit exhaust pipe 28.

The drive unit 12 and engine 14 are attached at the transom bracket assembly 13 with a vertical pivot assembly 30 for left-right steering movement and a horizontal pivot assembly 29 for up-down trim and launch movement.

The invention is directed to a novel non-contact coupler assembly 31 connecting the engine exhaust pipe 18 and the drive unit exhaust pipe 28. This coupler assembly provides an exhaust path which permits a controlled amount of exhaust gas leakage.

The coupler assembly is described in four embodiments. The first embodiment illustrated in FIGS. 1 through 4 and the second embodiment illustrated in FIGS. 5 and 6 include a solid exhaust coupler pipe extending from the drive unit and a flexible exhaust coupler pipe extending from the engine, the ends of which are spaced, do not interconnect and which maintain a connecting exhaust path during both horizontal and vertical movement of the drive unit. The third embodiment illustrated in FIGS. 7 and 8 and the fourth embodiment illustrated in FIGS. 9 and 10 include a solid exhaust coupler pipe extending from the engine, the ends of which overlap in a telescopic-spaced manner, are not attached and which also maintain an aligned exhaust path during both horizontal and vertical movement of the drive unit.

In the first embodiment illustrated in FIGS. 1 through 4 the flexible engine exhaust coupler pipe 31 forms the engine side of the exhaust coupler assembly 32. The engine exhaust coupler pipe 31 is attached to the engine exhaust pipe 33 integrally cast in the transom bracket assembly 13 with a band clamp 34. The engine exhaust coupler pipe 31 is formed of a synthetic elastomer neoprene rubber or other suitable material which is capable of accepting the maximum temperature of the exhaust gases without deterioration. The end portion 35 of the engine exhaust coupler pipe 31 which mates with the end portion of the drive unit exhaust coupler pipe 36 as will be described is formed with an eliptical cross-section. The major axis of the eliptical cross-section is positioned substantially horizontal and the minor axis substantially vertical.

Figure 2:
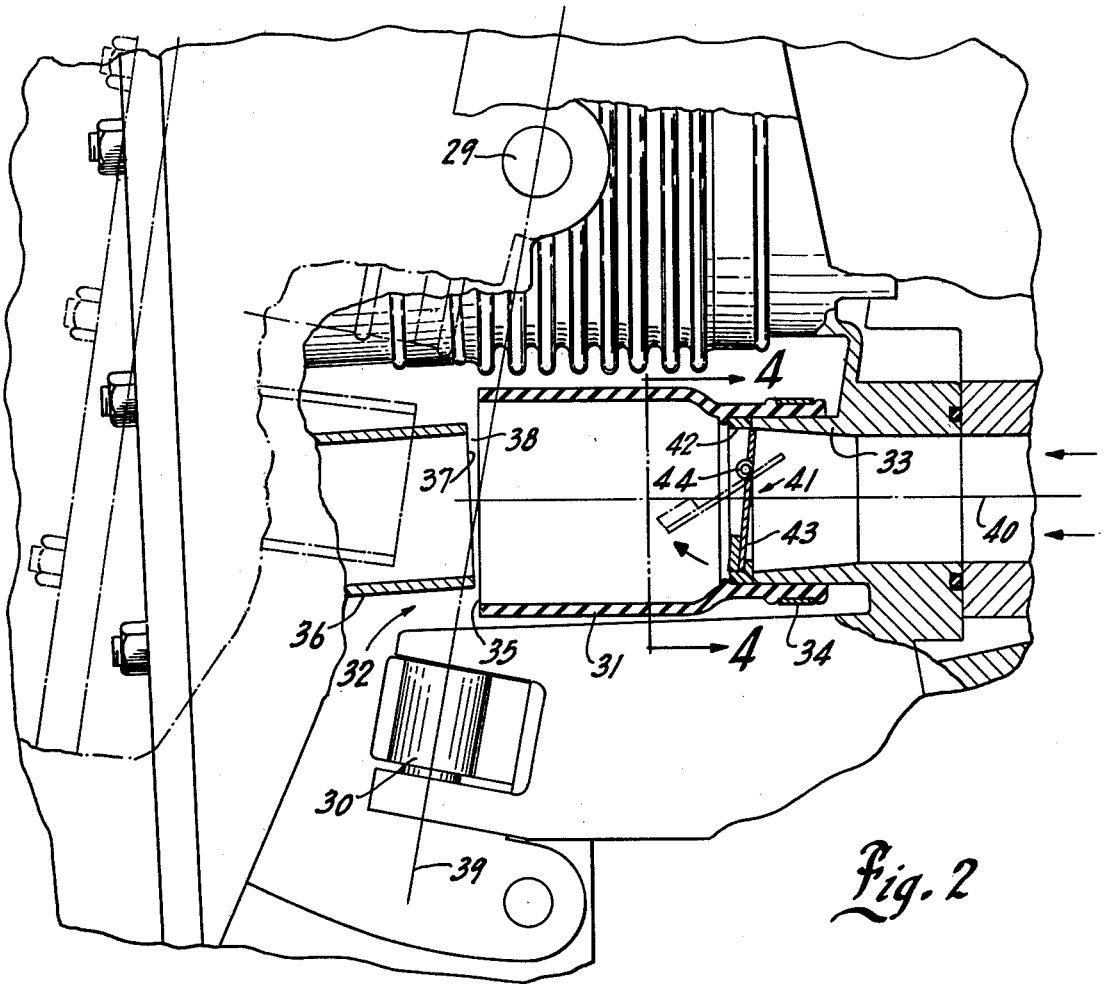
FIG. 2 is an enlarged fragmentary view of FIG. 1.
Figure 3:
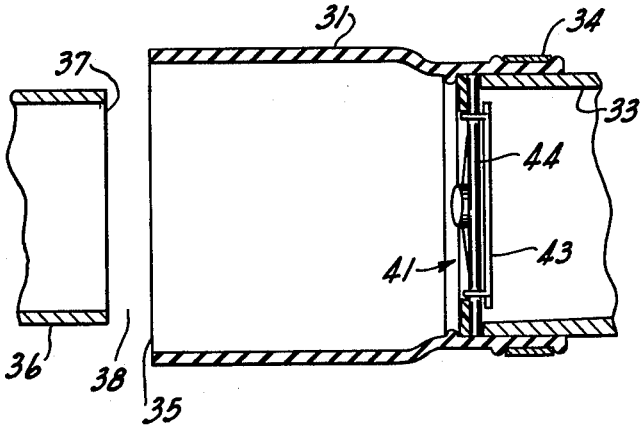
FIG. 3 is a sectional view taken generally on line 3—3 of FIG. 2.

The mating drive unit exhaust coupler pipe 36 attaches to the drive unit exhaust pipe 28 at the drive unit housing 21. In FIGS. 1 through 4 the drive unit exhaust pipe 28 is integrally cast with the drive unit housing 21 with the drive unit exhaust coupler pipe 37 end projecting towards the engine 14. The drive unit exhaust pipe coupler end 37 is also formed with an eliptical cross-section which is smaller than the cross-section of the engine coupler pipe 31. FIGS. 2 and 3 illustrate that the engine exhaust coupler pipe end 35 and the drive unit exhaust coupling pipe end 37 generally correspond in size and configuration.

The position of the exhaust coupler assembly 32 is very important. The ends 35 and 37 have a space 38 therebetween of about ¼ to ½ inch as shown in FIG. 1. This space 38 is necessary to accommodate the horizontal and vertical movement of the drive unit 12 without interference in the exhaust coupler assembly 32. Although under some operating conditions exhaust gas leakage will occur this amount is very small and carefully controlled by the size of the space 38.

Referring to FIG. 2 the exhaust coupler assembly 32 is shown positioned below the universal means 16 and below the horizontal pivot 29. The intersection between the engine and drive unit exhaust pipe coupler ends 35 and 37 is substantially in the plane 39 established by the vertical pivot assembly 30 axis and horizontal pivot assembly 29. The engine exhaust coupler pipe end 35 is fixed in a position with the horizontal center axis 40 about intersecting the plane 39. The drive unit exhaust coupler end 37 which moves with the drive unit 12 is positioned so that at the lowest trim position the drive unit exhaust coupler pipe end 37 does not contact or interfere with the engine exhaust coupler pipe end 35. FIG. 2 illustrates the position of the drive unit coupler pipe end 37 in phantom lines with the drive unit 12 in the tilt or launch position.

In addition to the position of the exhaust coupler assembly 32 with respect to the plane 39 the shape of the ends 35 and 37 also is important. The particular size and shape must maintain an interengagement of the ends with minimal exhaust gas leakage and no interference during all vertical and horizontal movement of the drive unit 12.

Figure 4:
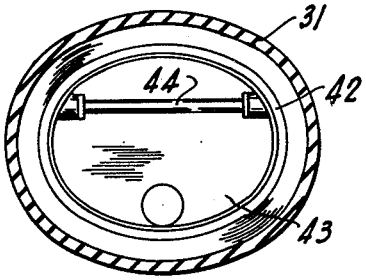
FIG. 4 is a sectional view taken generally on line 4—4 of FIG. 2.

Referring to FIG. 4 the ends 35 and 37 are shown to have an eliptical shape. This shape better accommodates the vertical movement of the drive unit and permits positioning the exhaust coupler assembly 32 in the limited space between the universal joint flexible cover 17 and the lower vertical pivot 30. During pivoting of the drive unit 12 about the vertical axis the drive unit exhaust coupler pipe end 36 pivots about the minor eliptical axis. Although this increases the space 38 between the coupler ends at one side it corresponding decreases the space 38 at the other side to provide substantially the same opening 38 under all vertical movement of the drive unit 12.

The novel exhaust coupler assembly 32 permits freedom of movement for both maximum horizontal trim and maximum vertical steering. This eliminates the need for a flexible bellows coupler which must not only flex to accommodate trim and steering but which must also flex to accommodate movement of the drive unit to the maximum tilt up launch position. The total amount of flexture needed for trim and steering is small but the additional movement required for tilt up to the launch position is large and difficult to obtain with a flexible exhaust coupler. The novel exhaust coupler assembly 32 includes simple exhaust coupling pipes which, since they do not continually flex, have a longer life than the flexible bellows coupler. In addition since the novel exhaust coupler is two non-connecting coupler pipes the drive unit can be removed without a disconnection such as required for the flexible bellows coupler.

FIGS. 1 through 3 also illustrate a shutter unit 41 which is used to close the engine exhaust pipe 18 to prevent water flowing into the engine 14 during reverse operation of the engine. The shutter unit 41 includes a retainer ring 42 with a flat metal shutter plate 43. The shutter plate 43 is pivotally supported on a horizontal shaft 44. The shaft 44 extends horizontally through the shutter plate 43 above the horizontal centerline of the shutter plate 43. This results in the weight of the lower portion of the shutter plate 43 maintaining the shutter plate 43 in the closed position. Under engine operation the shutter plate 43 is opened by engine exhaust gas pressure.

Figure 5:
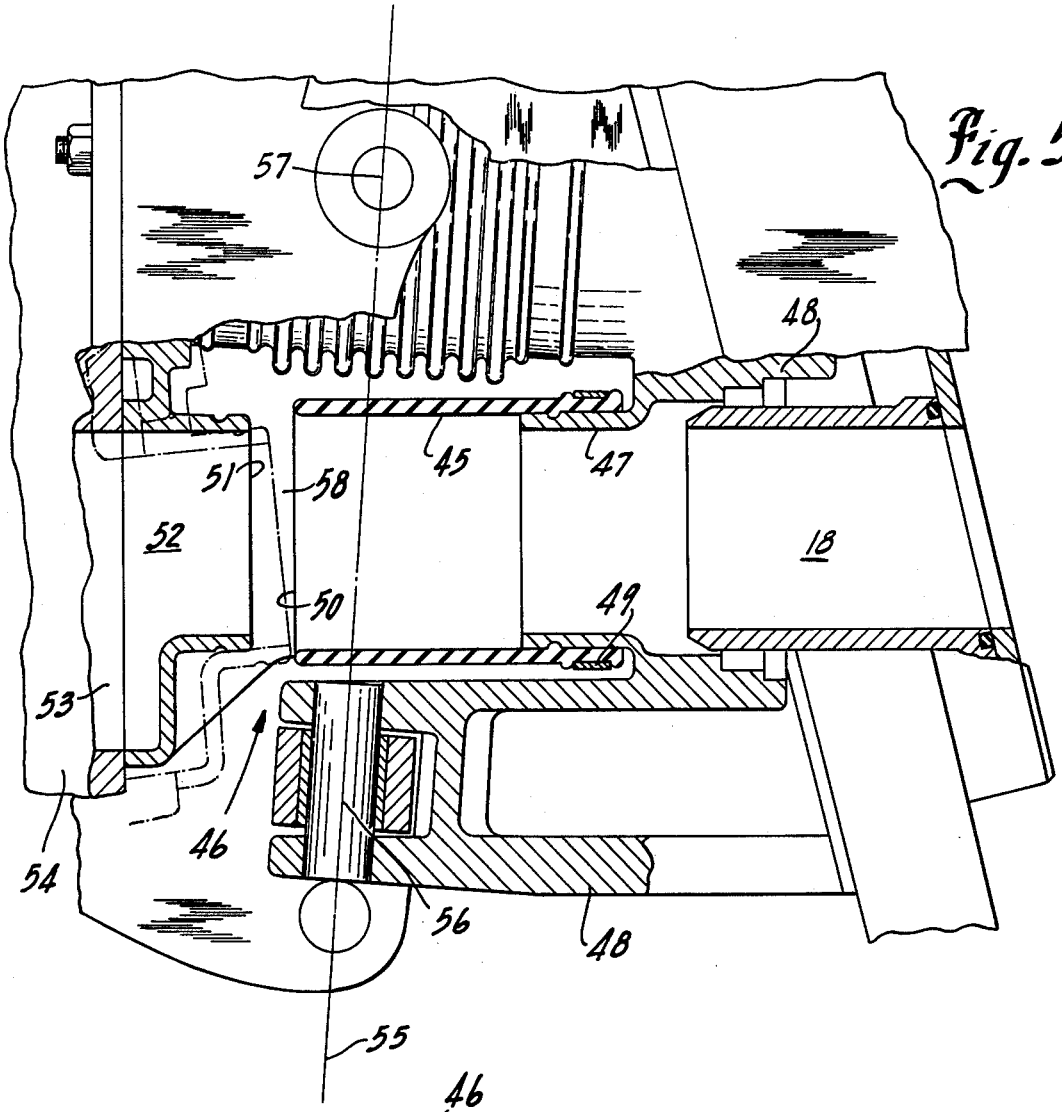
FIG. 5 is a view similar to FIG. 2 illustrating an alternate embodiment.
Figure 6:
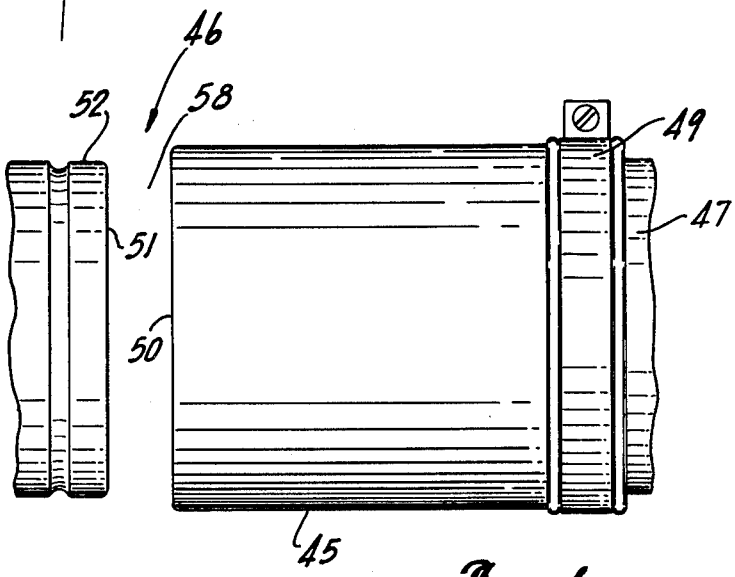
FIG. 6 is a fragmentary planned view of the exhaust coupling shown in FIG. 5.

In the second embodiment illustrated in FIGS. 5 and 6 the flexible engine exhaust coupler pipe 45, formed of a material similar to that of the first embodiment, also forms the engine side of an exhaust coupler assembly 46. It is attached to the engine exhaust pipe 47 integrally cast in the transom bracket assembly 48 with a band clamp 49. The engine exhaust coupler pipe end 50 which mates with the drive unit exhaust coupler pipe end 51 is formed with a round cross-section.

The mating drive unit exhaust coupler pipe 52 attaches to the drive unit exhaust pipe 53 at the drive unit housing 54. The drive unit exhaust coupler end 51 is also formed with a round cross-section which is smaller than the cross-section of the engine exhaust coupler pipe end 50.

The vertical pivot for the stern drive of the second embodiment shown in FIG. 5 is not in the same position as previously described for the first embodiment. Therefore, the position and shape of the ends of the exhaust coupler assembly 46 are modified. First the engine exhaust coupler pipe end 50 extends about 2 inches behind (towards the drive unit) the plane 55 established by the vertical axis 56 and horizontal axis 57. Second the space 58 between the ends 50 and 51 is larger and third the ends have a round cross-section of larger cross-section area. The larger round size provides an exhaust flow path with minimal pressure restriction thereby permitting a slightly larger opening between the ends 50 and 51. Functionally the second embodiment illustrated in FIGS. 5 and 6 is equivalent to the first embodiment illustrated in FIGS. 1 through 4. With respect to these two embodiments the first embodiment is preferred. Although not illustrated the second embodiment may also include a shutter assembly.

Figure 7:
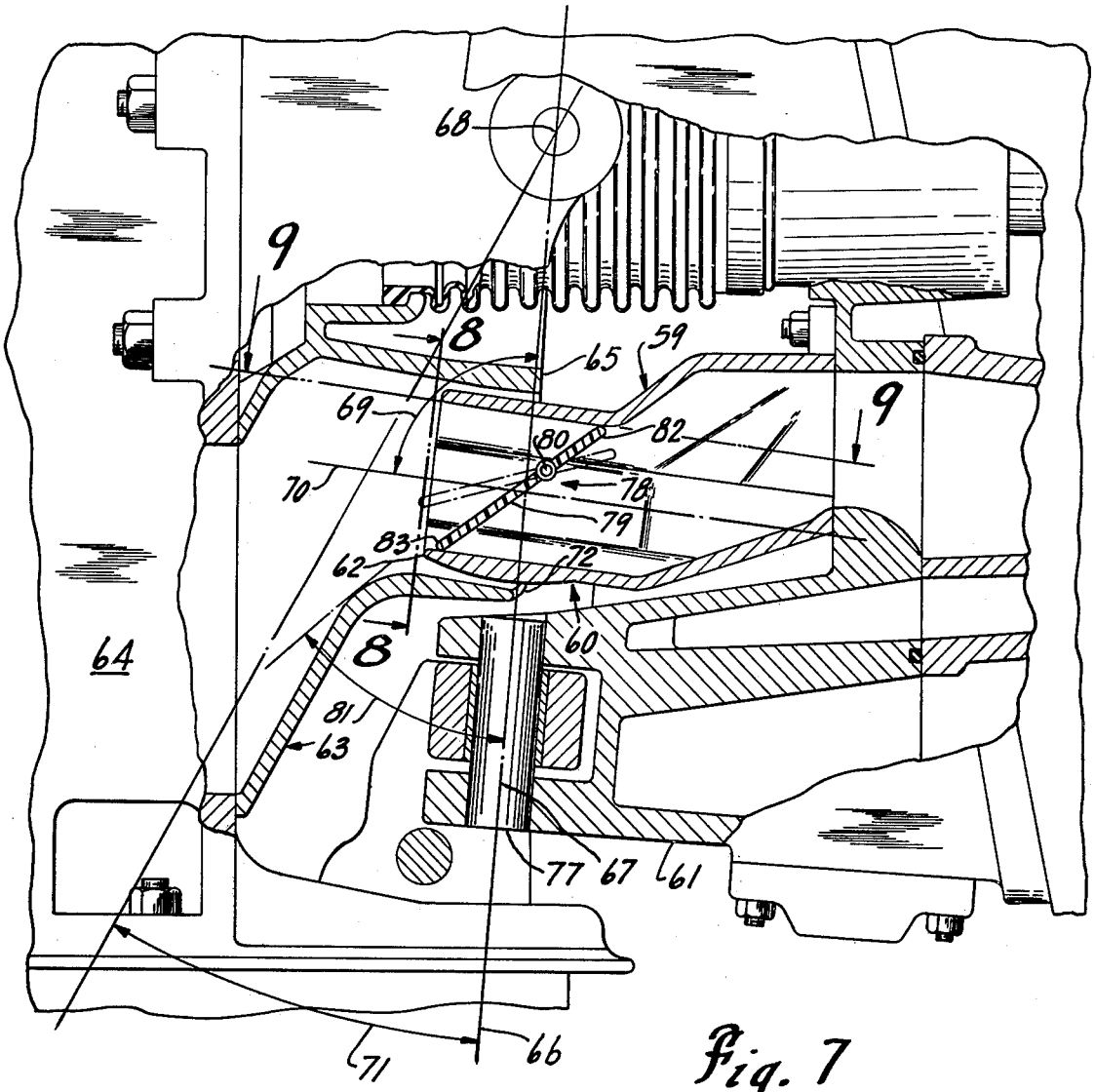
FIG. 7 is a view similar to FIG. 2 showing a third embodiment of the invention.
Figure 8:
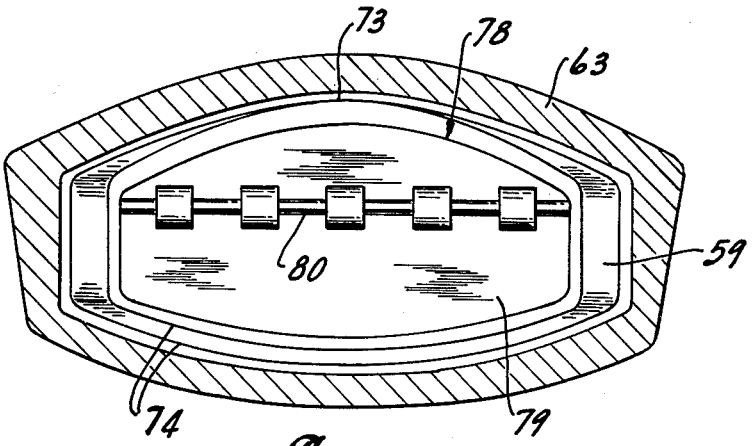
FIG. 8 is a view taken generally on line 8—8 of FIG. 7.
Figure 9:
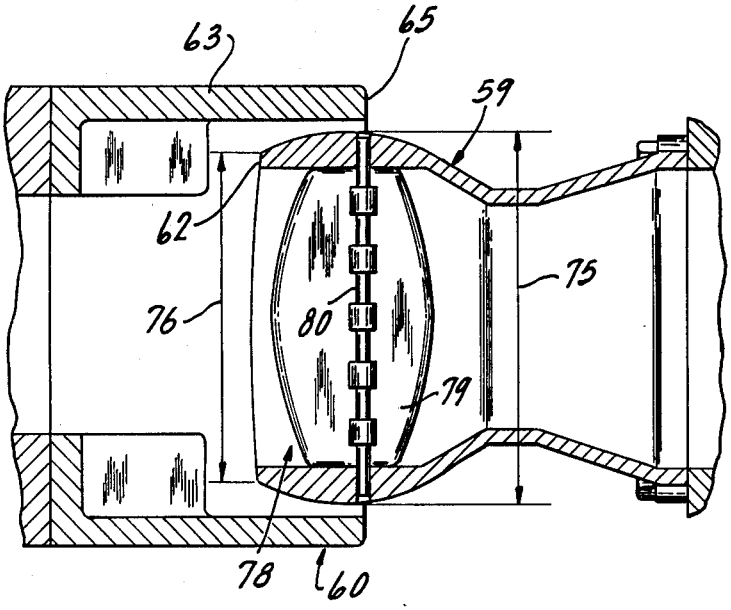
FIG. 9 is a view taken generally on line 9—9 of FIG. 7.

In the third embodiment illustrated in FIGS. 7, 8 and 9 the solid engine exhaust coupler pipe 59 forms the engine side of the exhaust coupler assembly 60. The engine exhaust coupler pipe 59 is bolted to the transom bracket assembly 61 as shown in FIG. 7. The engine exhaust coupler pipe 59 is formed bent and of varying cross-section to permit attachment at one end to the transom bracket; to properly aim the engine exhaust coupling pipe end 62 at the angle and elevation necessary to mate with the drive unit exhaust coupler pipe 63; and with the proper end shape to accommodate all the vertical and horizontal movements of the drive unit previously described.

The mating drive unit exhaust coupler pipe 63 is integrally formed with the drive unit housing 64. The drive unit exhaust coupler pipe 63 is also formed bent with the drive unit exhaust coupling pipe end 65 aimed at an angle and elevation necessary to mate with the engine exhaust coupler pipe end 62 as shown in FIG. 7. The drive unit exhaust coupler pipe end surface 65 is about at the plane 66 established by the vertical pivot axis 67 and horizontal pivot 68 axis when the drive unit 12 is at the lowest trim position.

The engine exhaust coupler pipe 62 end when the drive unit 12 is at the lowest trim position (shown in FIG. 7) telescopes within the drive unit exhaust coupler end 64 about 2 inches. As shown in FIG. 7 the angle 69 between the plane 66 and the center axis 70 of the exhaust coupler assembly 60 is about 85°. This angle permits the drive unit exhaust coupler end 64 to move in an arc 71 about the horizontal pivot axis 68 without any interference with the engine exhaust coupler pipe end 62. An opening 72 of about ⅛ inch between the inside diameter of the drive unit exhaust coupler pipe end and the outside diameter of the engine exhaust coupler pipe end 62 accommodates manufacturing tolerances and variations in cast shapes.

The shape of the ends 62 and 72 of the third embodiment is illustrated in FIGS. 8 and 9 as rectangular with curved top and bottom surfaces 73 and 74. The shape of the engine coupler end is also curved inward as shown in FIG. 9 from an outside dimension 75 at the intersection with the end 72 to an outside dimension 76 at the end 62. This corresponds to a radius about the vertical pivot 77 permitting full movement of the drive unit 12 about the vertical pivot 77 without interference at the exhaust coupler assembly 60.

The third embodiment also includes a shutter unit 78 illustrated in FIG. 9 similar to the shutter unit 41 in the first embodiment. FIGS. 7, 8 and 9 illustrate a shutter plate 79 pivotally mounted on a shaft 80. The shaft 80 extends horizontally through the shutter plate 79 above the horizontal centerline to utilize the weight of the bottom half of the shutter plate 79 in maintaining the shutter plate 79 in the normal position closing the engine exhaust coupler pipe 59. The outside shape of the shutter plate 70 conforms to the inside shape of the engine exhaust coupler pipe 59 at about a 45 degree angle 81 as shown in FIG. 7. At the angle position the top and bottom surfaces 82 and 83 engage the top and bottom inside wall of the engine exhaust coupler pipe 59 so that these walls act as stops. Therefore the shutter plate 79 prevents the inflow of water into the engine 14.

Figure 10:
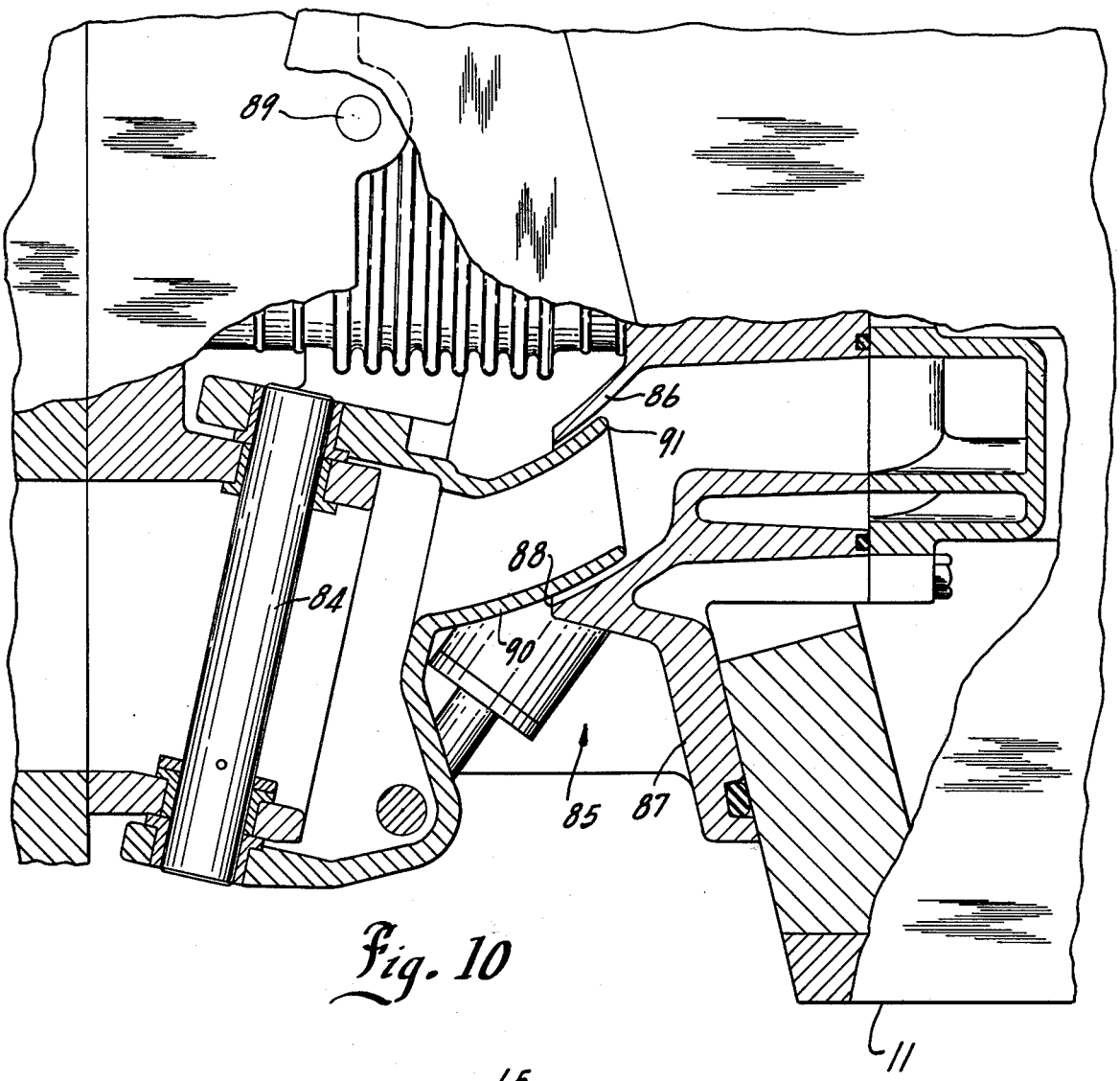
FIG. 10 is a view similar to FIG. 2 showing a fourth embodiment of the present invention.

FIG. 10 illustrates a fourth embodiment which because of the long design length of the lower vertical pivot 84 requires a different shape exhaust coupler assembly 85. The engine exhaust coupler pipe 86 is formed as part of the transom bracket 87. It includes an engine exhaust coupling pipe end 88 formed at the top and bottom on radii about the horizontal pivot 89.

The mating drive unit exhaust coupler pipe 90 attaches to the drive unit 12 at the lower vertical pivot 84 and pivots about the horizontal pivot 89 as shown in FIG. 10. During vertical steering of the drive unit 12 the drive unit coupler pipe 91 remains in a fixed vertical position since the drive unit pivots about the vertical pivot 84.

The drive unit exhaust coupler pipe end 91 telescopes into the engine exhaust coupler pipe for a distance of about 2 inches at the lower most trim position (shown in FIG. 10). The opening between the inside diameter of the engine exhaust coupler pipe end 88 and the outside diameter of the drive unit exhaust coupler pipe end 91 is about ⅜ inch.

A shutter unit 78 may also be used with the fourth embodiment.

I claim:

1. A stern drive for propulsion of a boat including (A) an inboard engine having an exhaust passageway means, (B) an outboard driven unit coupled to the engine having an exhaust passageway means, (C) a transom mounting assembly including pivot mounting means positioned between the inboard engine and the drive unit, the pivot mounting means including a vertical pivot axis for steering of the drive unit and a horizontal pivot axis for trimming of the drive unit, the improvement which comprises (a) a first exhaust pipe connected to said inboard engine exhaust passageway means and extending outward through the transom of a boat and having an open end position centered on, adjacent said vertical pivot axis, and below said horizontal pivot axis (b) a second exhaust pipe connected to said exhaust passageway means of said drive unit, said second exhaust pipe pivoting with the trim movement of the drive unit and extending towards and ending in alignment with said end position of said first exhaust pipe to form an interface therebetween which includes an opening therebetween providing a substantially equal exhaust leakage over the entire pivotal steering movement of the drive unit for any given trim position of the drive unit.

2. The stern drive defined in claim 1 wherein said interface includes an overlap of said first exhaust pipe end and said second exhaust pipe end; said overlap being of a length to permit movement about said horizontal pivot axis of an amount to trim an operating boat but less than an amount to raise the drive unit higher than the maximum upper operating trim position.

3. The stern drive defined in claim 2 wherein said end of said second exhaust pipe includes curved walls with sidewall curves centered from said vertical pivot axis and a bottom wall centered from said horizontal pivot axis and a top wall centered from an axis parallel to the horizontal pivot axis.

4. The stern drive defined in claim 3 wherein said end of said first exhaust pipe includes complementary curved top and bottom walls with the overlapping curved top and bottom wall end of said second exhaust pipe.

5. The stern drive defined in claim 2 wherein said first exhaust pipe end has bowed top and bottom walls connected to circular-shaped sidewalls and said second exhaust pipe end has straight sidewalls and bowed top and bottom walls, said first exhaust pipe end being of smaller size than said second exhaust pipe end and extending into said second exhaust pipe end to form said overlap without interference over the entire pivotal steering and trim movement.

6. The stern drive defined in claim 2 wherein said overlapping ends of said first exhaust pipe and said second exhaust pipe have inner and outer dimensions of different sizes for free telescopic movement of the second exhaust pipe to maintain an essentially unobstructed encircling spacement therebetween.

7. The stern drive defined in claim 1 wherein said interface includes an essentially constant space between the end of said first exhaust pipe and the end of said second exhaust pipe.

8. The stern drive defined in claim 1 additionally comprising (a) valve means within the first exhaust pipe which is normally closed to prevent the inward flow of fluid and which opens in response to the outward flow of exhaust gases.

9. The stern drive defined in claim 8 wherein said valve means includes (i) a rigid shutter (ii) a pivot shaft supported in the first exhaust pipe and extending horizontally through the shutter below the top edge of the rigid shutter and at a distance above the horizontal centerline thereof sufficient to counterbalance said shutter into a normally closed position, and (iii) stop means within said first exhaust pipe to prevent reverse opening of said shutter upon the inward flow of a fluid.

10. A stern drive for propulsion of a boat including (A) an inboard engine having an exhaust means, (B) an outboard drive unit coupled to the engine having an exhaust passageway means, (C) a transom mounting assembly including pivot mounting means positioned between the inboard engine and the drive unit, the pivot mounting means including a vertical pivot axis for steering and a horizontal pivot axis for trimming of the drive unit, the improvement which comprises (a) a first exhaust pipe connected to said inboard engine exhaust means, (b) a second exhaust pipe connected to said exhaust passageway means of said drive unit, said first and said second exhaust pipes having overlapping ends on about the vertical pivot axis and below the horizontal pivot axis and with a free opening to atmosphere between the overlapping ends, the shape of the overlapping end walls permitting motion of the drive unit about both the vertical pivot axis and the horizontal pivot axis over the entire vertical pivot range and over an operating trimming position of the horizontal pivot axis without substantially changing the free opening to atmosphere between the overlapping ends.

* * * * *

UNITED STATES PATENT AND TRADEMARK OFFICE

CERTIFICATE OF CORRECTION

PATENT NO. : 4,178,873

DATED : December 18, 1979

INVENTOR(S) : Herbert A. Bankstahl

It is certified that error appears in the above-identified patent and that said Letters Patent are hereby corrected as shown below:

| | | |
|---|---|---|
| ABSTRACT, | Line 6, | After "for" cancel "steering"; |
| ABSTRACT, | Line 7, | Beginning of sentence cancel "and horizontal pivoting of the drive unit for"; |
| Column 3, | Line 57, | After "it" cancel "corresponding" and substitute therefore --- correspondingly ---; |
| Column 5, | Line 46, | After "plate" cancel "70" and substitute therefore --- 79 ---; |
| Column 6, | Line 5, | After "about" cancel "3/8" and substitute therefore --- 1/4 ---. |

Signed and Sealed this

*Twenty-seventh* Day of *May 1980*

[SEAL]

*Attest:*

SIDNEY A. DIAMOND

*Attesting Officer*

*Commissioner of Patents and Trademarks*